United States Patent [19]

DiSabatino

[11] Patent Number: 4,583,469

[45] Date of Patent: Apr. 22, 1986

[54] INCINERATOR

[75] Inventor: Sabatino DiSabatino, Towaco, N.J.

[73] Assignee: Sani-Therm, Inc., Nutley, N.J.

[21] Appl. No.: 745,205

[22] Filed: Jun. 17, 1985

[51] Int. Cl.[4] ..... F23G 5/12

[52] U.S. Cl. ..... 110/346; 110/210; 110/212

[58] Field of Search ..... 110/235, 210, 211, 212, 110/223, 346

[56] References Cited

U.S. PATENT DOCUMENTS

| | | | |
|---|---|---|---|
| 3,970,011 | 7/1976 | Virr et al. | 110/346 |
| 4,300,460 | 11/1981 | Lamb et al. | 110/213 |
| 4,354,440 | 10/1982 | McRee, Jr. | 110/346 |
| 4,453,476 | 6/1984 | Erlandsson | 110/212 |
| 4,474,121 | 10/1984 | Lewis | 110/210 |
| 4,485,746 | 12/1984 | Erlandsson | 110/346 |

*Primary Examiner*—Henry C. Yuen

*Attorney, Agent, or Firm*—Marvin Feldman

[57] ABSTRACT

An incinerator for combustible waste materials including a combustion chamber having a side charging entrance with a base no lower than the mid-plane of the combustion chamber. A ram moves waste materials in an elongated hopper connected to the side charging door into the combustion chamber. A fire door is raised to open the charging entrance and lowered to seal the charging entrance. An elevator positioned under the hopper is charged with waste materials and raised to the level of the hopper until the platform of the elevator becomes the bottom of the hopper on a horizontal level with the base of the charging entrance. An after burner unit can be positioned over the combustion chamber. A heat recovery unit is positioned over the after burner to recover heat from the combustion for use in an outside heating unit.

13 Claims, 5 Drawing Figures

INCINERATOR

BACKGROUND OF THE INVENTION

This application relates to incinerators for burning combustible rubbish and garbage, and particularly to medium-speed incinerators.

One of the problems encountered in such incinerators is in the loading process. Incinerators of the type discussed here are loaded in two ways. One method is to stuff the waste materials into the bottom of the combustion chamber. Another method is to gravity top load the combustion chamber, which necessitates raising the waste material completely over the combustion chamber from where it is passed into the chamber. The top loading process is described in my U.S. Pat. No. 3,881,431.

The problem with top loading is that a great deal of energy is expended in raising the waste materials completely over the combustion chamber.

The problem with bottom loading is that the waste materials must be stuffed into the incinerator. This expends energy. Also, the waste materials are not in a condition for full combustion.

One invention that attempts to deal with these problems is described in U.S. Pat. No. 4,074,638 issued to Miller. There, a hydraulically operated ram is mounted for reciprocating movement in the lower portion of the primary combustion chamber. Located opposite the ram is a discharge door. The ram enters the combustion chamber and agitates highly compacted waste and also fully extends to push the ash and non-combustible materials to a collection site.

The problem with the Miller invention is that it does not solve the problems of stuffing in the waste materials at the lower portion of the combustion chamber. The energy expended in raising and stuffing the waste materials in the combustion chamber results in the waste materials so tightly packed that they are not readily combustible. Also, two rams are needed, one for stuffing and one for agitation and removal.

Other prior art patents in the field of the art of incinerators being discussed here besides my previous patent are as follows: U.S. Pat. Nos. 3,855,950 issued to Hughes Dec. 24, 1974; and U.S. Pat. No. 3,749,031 issued to Burden, Jr. July 31, 1973. Patents discussed in my U.S. Pat. No. 3,881,431 include U.S. Pat. Nos. 3,215,101; 3,248,178; and 3,355,254 issued to Hoskinson; also U.S. Pat. Nos. 3,610,179; 3,631,823; 3,651,771; and U.S. Pat. No. 3,567,399. Patents cited in my prior patent are U.S. Pat. Nos. 3,552,332; 3,651,771; 3,664,277; 3,749,031; and 3,782,301.

It is also noted that a large amount of energy is lost to the atmosphere during incinerator burning operations. During the winter months this lost energy results in a low efficiency operation even when the burning of the rubbish is 100 percent efficient since the energy input is entirely lost.

It is noted here that many incinerators of the type being discussed here includes an after burner unit over the combustion chamber. This type of unit is set forth in my prior U.S. Pat. No. 3,881,431 and in Miller, U.S. Pat. No. 4,074,638. Starved air combustion systems as well-known in the art of incinerators are described in both patents.

SUMMARY OF THE INVENTION

Accordingly, it is an object of the present invention to provide an incinerator that includes a side loader system for waste materials that is aligned no lower than the center line of the cylindrical primary combustion chamber.

It is another object of the present invention to provide an incinerator that injects the air into the combustion chamber through apertures at the bottom of the primary chamber, and also includes a side charging entrance located at or above the horizontal mid-plane of the incinerator.

It is yet another object of the present invention to provide an incinerator that includes a combination of a side loader system at or above the center line of the combustion chamber with the injection of air into the bottom of the primary combustion chamber in opposed jet streams.

It is yet a further object of the present invention to provide an incinerator that includes a charging elevator that lifts the waste material to a feed hopper having its bottom wall aligned with the center line of the combustion chamber which is aligned with the bottom side of a side charging door to the chamber.

It is still another object of the present invention to provide an incinerator that has a horizontal ram that forces the waste material through a feed hopper into the side of a cylindrical primary combustion chamber at or slightly above the horizontal midplane of the combustion chamber.

The incinerator system provided in accordance with the present invention includes a combustion chamber for burning combustible waste materials that has a horizontal midplane. The chamber has a side charging entrance having a bottom side disposed no lower, and preferably at, the horizontal midplane. A side charging apparatus co-extensive with the side charging entrance is adapted to load waste materials into the combustion chamber. Air is forced into the lower portion of the combustion chamber in opposed directions along a bottom outlet of the chamber.

The side charging apparatus includes an elongated, horizontal feed hopper box adapted to hold waste materials. The hopper box has an outlet co-extensive with the side charging entrance and opposed end wall. An elevator with a platform forms the bottom wall of the hopper box when the platform is in a raised position. When the elevator is in a lowered position it is below the midplane of the combustion chamber. The platform is enclosed by a housing that has a charging doorway covered by a hinged charging door so that waste materials can be loaded into the platform easily at the lowered essentially ground level position. A hydraulically operated ram is adapted to push waste materials in the hopper box through the side charging entrance into the combustion chamber. A fire door is raised by a hydraulic cylinder to uncover the side charging door prior to charging the chamber. A microswitch on the frameway of the firedoor is tripped when the fire door reaches its top position so as to activate movement of the elevator platform and, after a preset interval, movement of the ram to charge the combustion chamber.

The system includes an after burner over the primary combustion chamber, which can be of the starved air type. A heat recovery unit is preferably positioned downstream of the after burner.

Opposed rows of fire bricks are set at generally tangential angles on opposite sides of a longitudinal bottom outlet of the combustion chamber. The fire bricks form a plurality of air channels having downstream outlets on opposite sides of the bottom outlet and upstream inlets connected to the blower and duct system of the incinerator. The combustion chamber has an imaginary vertical longitudinal center plane with the bottom outlet being aligned along the centerplane with the air outlets of the fire bricks being set directly as to form jet air streams at approximate right angles to the center plane.

The present invention will be better understood and the objects and important features, other than those specifically enumerated above, will become apparent when consideration is given to the following details and description, which when taken in conjunction with the annexed drawings, describes, discloses, illustrates, and shows a preferred embodiment of the present invention and what is presently considered to be the best mode of practice in the principles thereof. Other embodiments or modifications may be suggested to these having the benefit of the teachings herein. Such other embodiments or modifications are intended to be reserved especially as they fall within the scope and spirit of the subjoined claims.

DESCRIPTION OF THE PREFERRED EMBODIMENT

Figure 1:
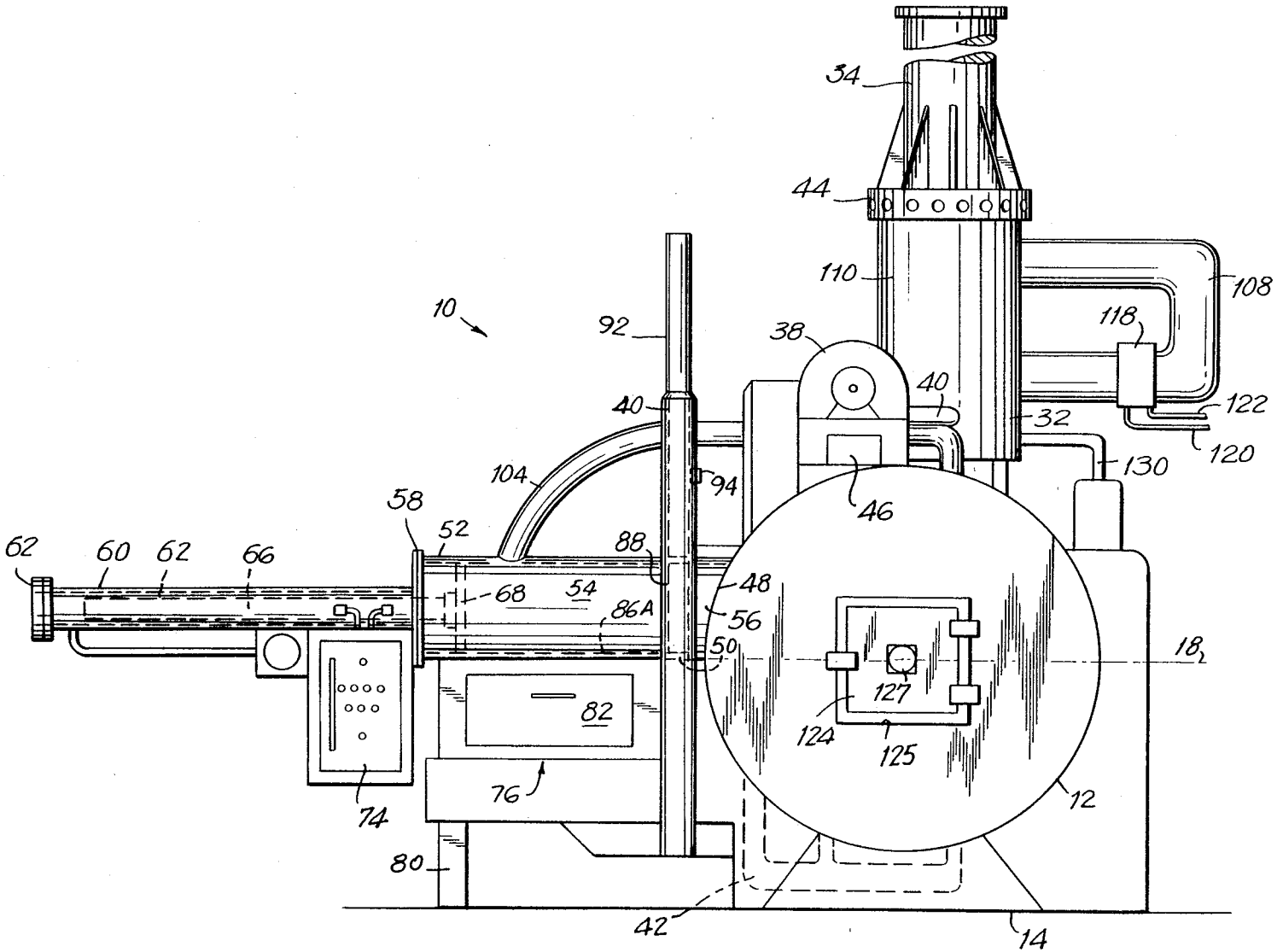
FIG. 1 is a frontal elevational view of the incinerator of the present invention.

Reference is now made in detail to the drawings, wherein like reference numerals denote corresponding parts.

The incinerator system described hereinabove is based upon a starved air type incinerator with an after-burner unit of the type described in my prior U.S. Pat. No. 4,117,931 for purposes of illustration only. The inventive features described below can be applied to any type of starved air incinerator.

Figure 2:
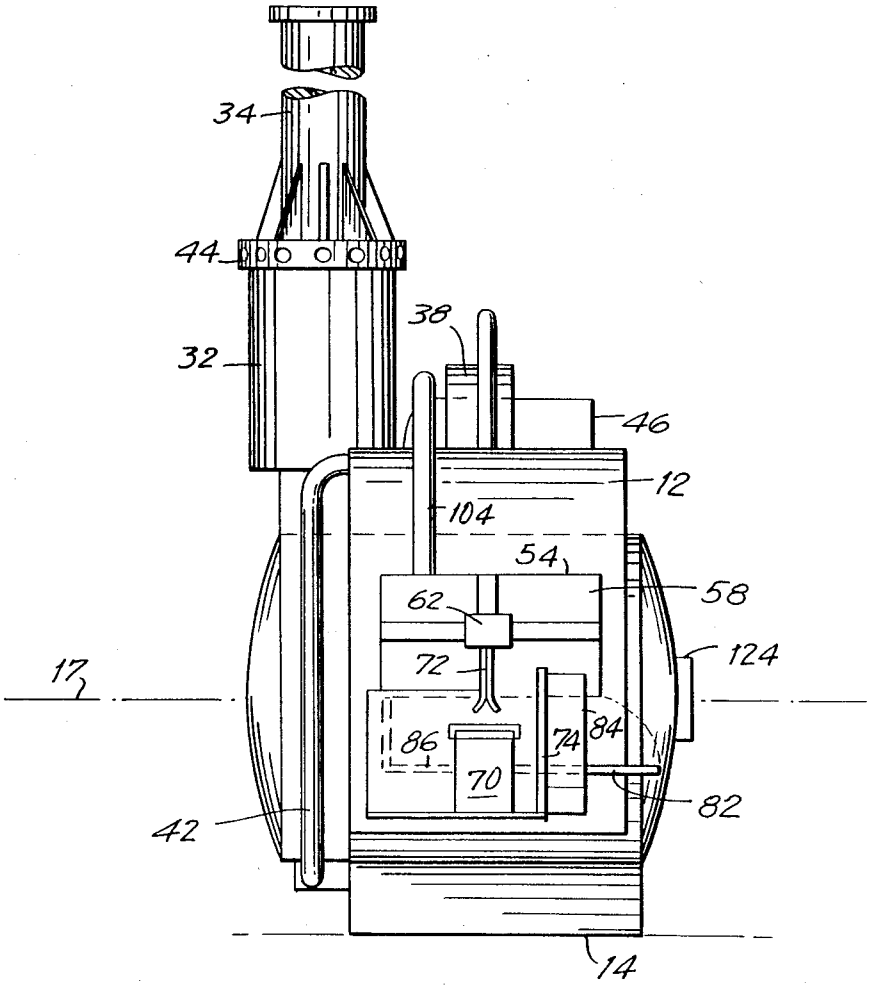
FIG. 2 is a side view of the incinerator.
Figure 3:
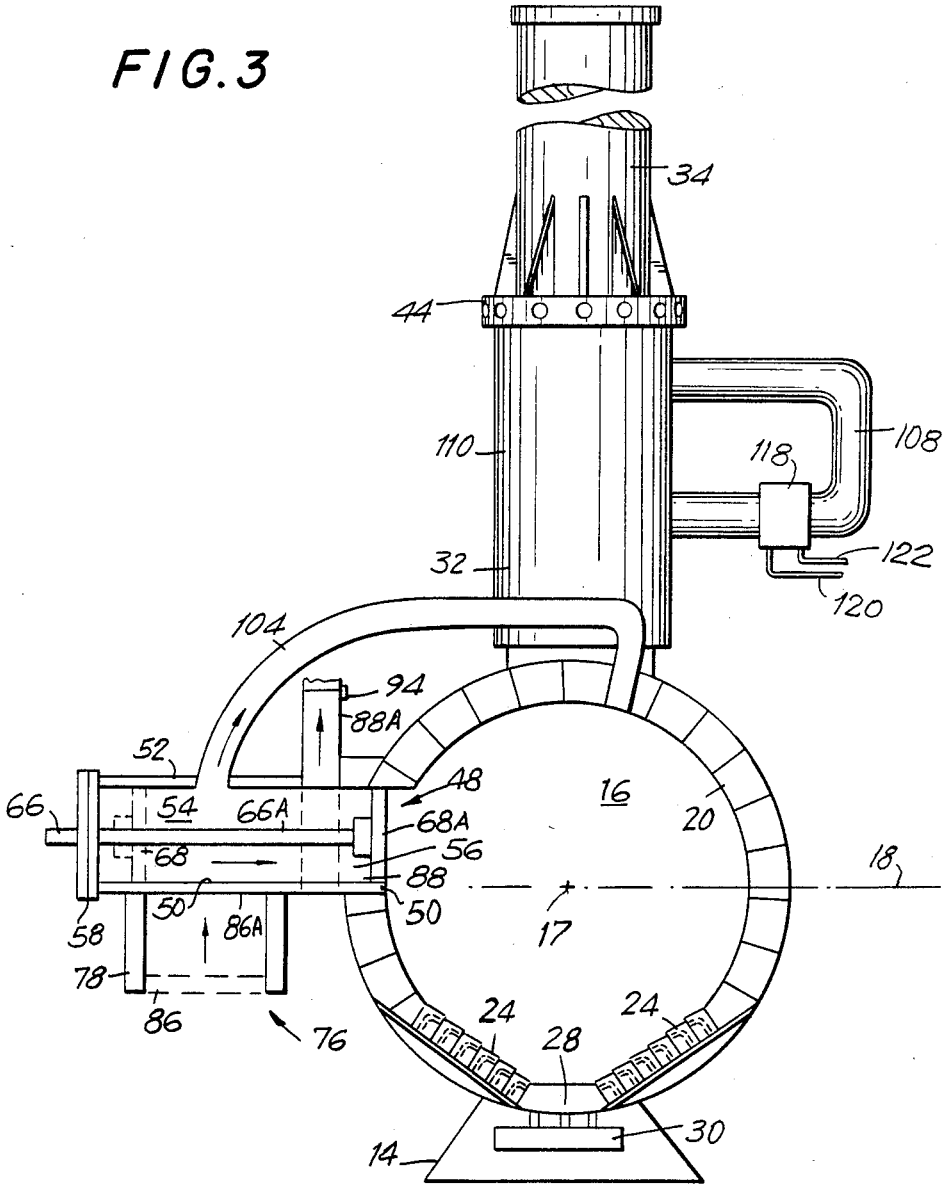
FIG. 3 is an end view cut-away schematic view of the incinerator.
Figure 4:
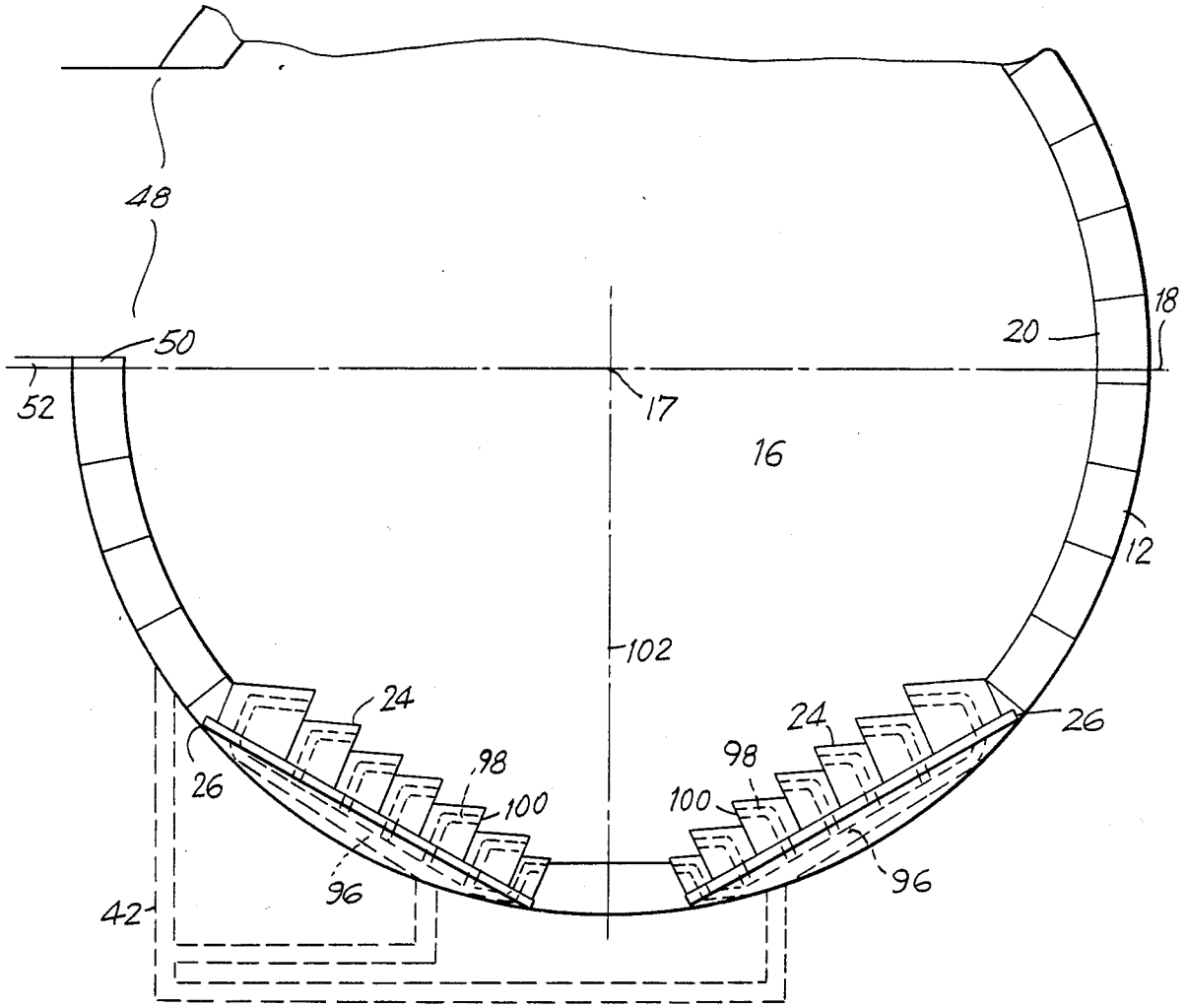
FIG. 4 is an isolated view of a cut-away end view of the bottom portion of the primary combustion chamber showing the inlet air jets.

FIGS. 1, 2 and 3 illustrate an incinerator system 10 for burning combustible waste materials that includes an elongated cylindrical casing 12 mounted on a base platform 14. Casing 12 forms a primary combustion chamber 16 having an inner surface and having a height. Primary combustion chamber is cylindrical having a horizontal elongated longitudinal axis 17 (FIG. 2) and circular in cross-section with a horizontal centerline, or mirror axis, which is aligned with an imaginary horizontal midplane 18 of primary combustion chamber 16 and which will be referred to herein as midplane 18. As seen in FIGS. 3 and 4, refractory materials 20 are mounted over the inner wall of casing 12 over an insulation in a manner known in the art. Fire bricks 24 are secured to the top surfaces of flat steel supports 26 angularly positioned in a general "V" configuration along approximately one-third of the inner surface of casing 12 with a longitudinal open portion adapted to pass ash from primary combustion chamber 16 through a plurality of passages 28 extending from an open area between fire bricks 24 to a collection tray 30 (FIG. 3).

Incinerator system 10 further includes an afterburner unit, or secondary combustion chamber, 32 mounted over in operative connection with primary combustion chamber 16, a stack assembly 34 mounted over and in operative connection with secondary combustion chamber 32, a fan, or blower, 38 for pressuring air via upper and lower ducts 40 and 42 to an aspirator ring 44 above after-burner unit 36 and to the lower portion of primary combustion chamber 16 respectively, the latter in a manner to be discussed in detail below. An air control system 46 maintains a negative air pressure in primary combustion chamber 16 to insure a slow, smouldering, smokey non-turbulent fire therein through adjustments of an automatic primary air damper (not shown). The benefits of creating a negative air pressure in primary combustion chamber 16 measured at the base of after-burner unit 36 combined with a very hot, tangentially fired after-burner for reburning rising ash and gases are discussed and set forth in greater detail in my U.S. Pat. No. 3,881,431, which is made a part of the disclosure herein by reference thereto.

Incinerator system 10 further includes casing 12 forming a side charging doorway, or entrance 48 to primary combustion chamber 16 having a bottom side 50 that is aligned with midplane 18 of primary combustion chamber 16. A rectangular, elongated, horizontal feed hopper box 52 forms a hopper chamber 54 adapted to hold waste materials (not shown). Hopper box 52 has a long dimension generally perpendicular to the longitudinal axis 17. Hopper box 52 has an outlet passage coextensive with side charging entrance 48 of casing 12 and an opposed end wall 58. Hopper box 54 has a horizontal bottom plane that is aligned with bottom side 50 of charging entrance 48 and midplane 18 of primary combustion chamber 14.

An elongated horizontal outer hydraulic ram tube 60 of cylindrical configuration is aligned perpendicular to the longitudinal of hopper box 52 at one end and a blind flange 62 at the opposite end. A cylindrical inner ram tube 64 concentrically positioned inside outer ram tube 62 is likewise connected to end wall 58 at one end and is spaced from flange 62 at the other end. A cylindrical ram piston 66 concentrically mounted and movable within inner ram tube 64 extends through end wall 58 into hopper chamber 54. Ram piston 66 is generally perpendicular to the vertical plane extending through longitudinal axis 17 of combustion chamber 16. A rectangular, vertically oriented ram blade 68 attached to the inner end of ram piston 66 is positioned in hopper chamber 54. A hydraulic power unit 70 (FIG. 2) operatively connected to inner and outer ram tubes 60 and 62 by way of hydraulic piping 72 is capable of driving ram piston back and forth in inner ram tube 62. A main control panel 74 includes hydraulic controls operatively connected to hydraulic power unit 70. Ram piston 66 is capable of moving ram blade 68 in hopper chamber 54 between first and second positions. In the first position, ram blade 68 is positioned proximate to end wall 58 of hopper 52 as shown in dotted lines in FIG. 1 and in phantom lines in FIG. 3. In the second position, ram blade 68 is positioned at side charging entrance 48 of first combustion chamber 14 as shown in solid lines in FIG. 3 and indicated as ram blade 58A. As seen in FIG. 3, ram piston 66 has been pushed into hopper chamber 54 by hydraulic force where it is indicated as ram piston 66A. Waste materials positioned in hopper chamber 54 are moved from the hopper chamber into first combustion chamber 14 when the hydraulic unit is activated at control panel 74 to move ram piston and ram blade from their first positions 66 and 68 to their second positions 66A and 68A.

Waste materials are loaded into hopper chamber 54 by an elevator 76 mounted in a housing 78 positioned directly below hopper box 52. Housing 78 is supported by legs 80 at one side and connected to base 14 at the other side. As seen in FIG. 2, a door 82 rotates on hinges secured to housing 78 parallel to ram piston 66 between a vertical position wherein door 82 closes a charging doorway 84 formed by housing 78 to a horizontal position as seen in FIG. 2 wherein charging doorway 84 is open to be charged with waste materials. Elevator 76 further includes a generally horizontal elevator platform shown in the lowered position in FIGS. 2 and 3 as platform 86 and in FIGS. 1 and 3 in the raised position as platform 86A. In the raised position as platform 86A, the platform becomes the bottom wall of hopper box 52, which, as described previously, has a bottom plane aligned with midplane 18 of prlmary combustion chamber 14. Elevator 76 is electrically operated in a conventional manner and is connected to an outside power source.

A fire door 88 adapted to seal off charging entrance 48 of casing 12 is vertically slidably mounted transverse to midplane 18 and hopper box 52 in a vertical frame 90. A hydraulic cylinder 92 set in frame 90 over fire door 88 is connected via piping (not shown) to hydraulic power unit 70. Fire door 88 is shown in its normally lowered position covering entrance 48 as shown in FIG. 1 and in its raised position as fire door 88A in FIG. 3 in preparation for charging of waste materials from hopper chamber 54.

A miscroswitch 94 is positioned at the end of the upward ram of fire door 88 to its raised position 88A so that fire door 88 trips microswitch 94 at the upper portion of frame 90 so as to activate an electical signal via an electric circuit (not shown) that causes hydraulic cylinder to deactivate the raising process of fire door 88. Microswitch 94 also simultaneously activates an electrical signal via an electric circuit (not shown) to the power unit for elevator 76 to activate raising loaded platform 86 to position 88A. Activation of microswitch 94 by fire door 88 also activates an electrical signal via an electric circuit (not shown) to activate hydraulic power unit 70 after a preset time delay to move ram piston 66 in hopper box 52 so as to force the waste materials just raised by elevator 76 to hopper chamber 54 and from the hopper chamber through charging entrance 48 into first combustion chamber 14. Ram blade 68 is then positioned over bottom side 50 of charging entrance 48 so as to cover the entire area of charging entrance 48 and act as a temporary fire door as shown in FIG. 3 with the ram blade shown as 68A. At this time the operator activates a reverse movement of the sequences described by causing a signal to be sent from main control panel 74. Automatic timing devices can trigger a reverse movement upon the ram blade reaching its position 68A. The reverse movement of first ram piston being activated to pull ram blade 68 back to its position adjacent to end wall 58; second, fire door 88 being dropped to from its open position at 88A to its closed position 88 wherein it operates as a fire door; and third, the power unit of the elevator platform is activated to move the platform from its raised position 88A to its lowered position 86.

Air pressured from blower 38 is directed via upper ducts 40 to secondary combustion chamber 32 and lower ducts 42 to both sides of the Vee of firebricks 24 at the bottom of primary combustion chamber 14, and in particular to air channels positioned in each of the firebricks 24. As seen in the schematic view of FIG. 4, the pressurized air is delivered to a pair of headers 96 positioned under steel support plates 26 from where individual air ducts 98 for each fire brick 24 conduct the air to a stepped portion of each fire bricks 24 to an outlet 100 that directs the air in a general cross-wise direction perpendicular to the vertical plane 102 of primary combustion chamber 14, that is, the air is directed in a line of movement spaced above the bottom of the chamber. This flow of pressurized air acts to fluff the pushed falling waste materials during the combustion process. This bottom movement of the air combined with the falling waste materials results in 100 percent combustion of the waste materials leaving only a fire ash.

FIG. 3 in particular illustrates exhaust smoke duct 104 which carries any smoke that has entered hopper box 52 during the charging process back to primary combustion chamber 14.

Figure 5:
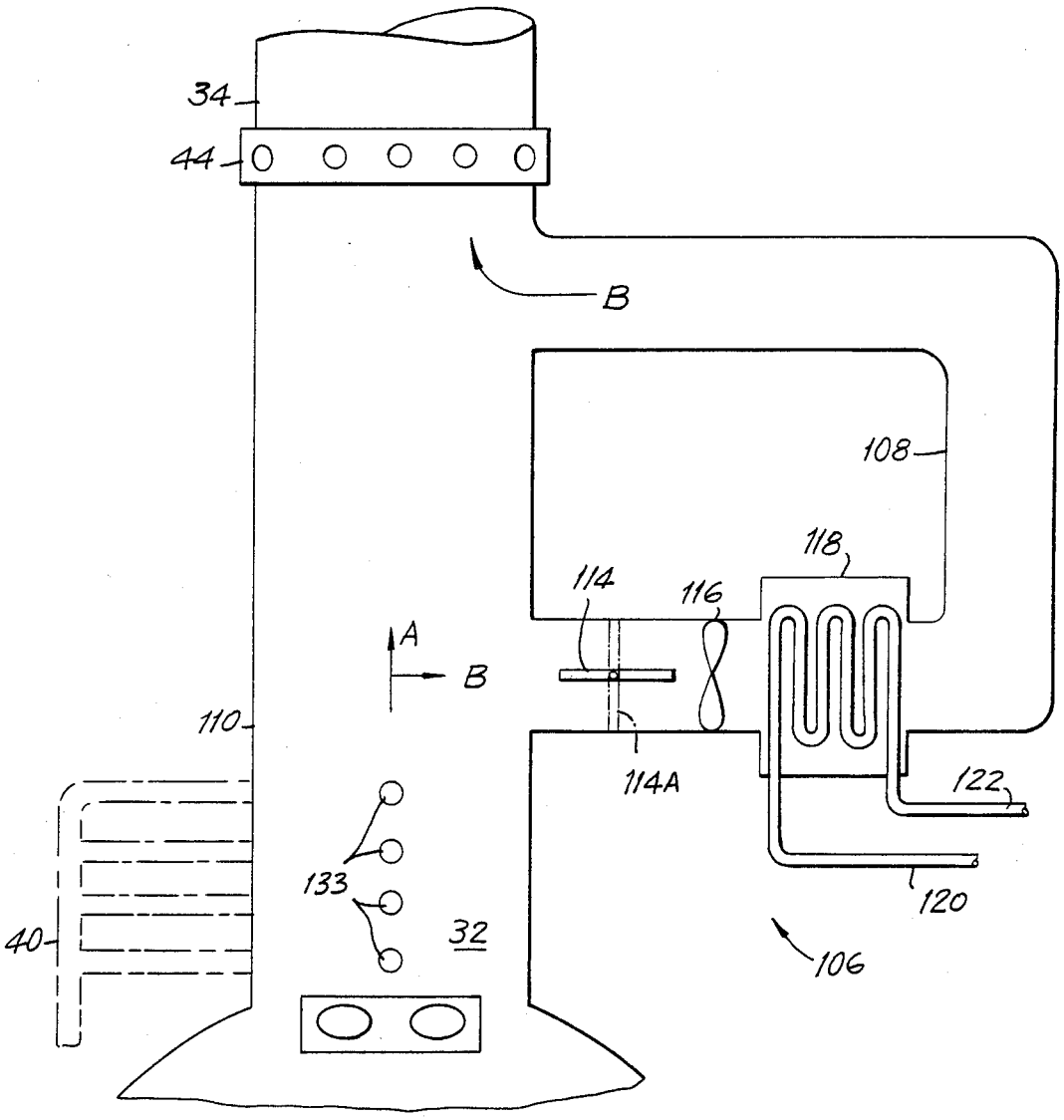
FIG. 5 is an isolated schematic view of the heat recovery unit at the stack of the incinerator, and of the secondary combustion chamber.

A heat recovery unit 106 shown in FIG. 5 draws the heat of the combustion into secondary combustion chamber 32 to an area for building or water heating. Heat recovery unit 106 includes a by-pass duct 108 that extends at right angles from main exhaust duct from an area immediately above secondary combustion chamber 32 to initiate a "U" bend to return again to a position immediately below stack assembly 34 and aspirator ring 44. Hot gases from primary combustion area 32 are passed straight up in main duct 108 in direction "A" or are passed to by-pass duct 108 at right angles to direction A in direction B through by-pass duct 108 to return to main duct 108. A by-pass duct control damper 114 is positioned in by-pass duct 108. By-pass control damper 114 is shown in a fully opened position in solid lines and a fully closed position 114A in phantom lines. Directly downstream of by-pass control valve is a suction fan 116 adapted to draw hot gases from main exhaust duct 110 into and through by-pass duct 108. Directly downstream of fan 116 is a heat exchanger unit 118 having inlet and outlet pipes 120 and 112 respectively that are connected to a heating unit (not shown). Heat exchanger unit 18 is shown schematically and can be of any of a number of heat exchanger type units known in the art. By-pass damper 114 can be controlled and suction fan 116 regulated so as to direct the flow of hot gases relatively more in one direction or another. In winter months, for example, the damper and fan may be so controlled as to make the B flow greater than the A flow; and in summer months the A flow can be made greater than the B flow.

A self-activating harmonic action damper as known in the art can be used in place of aspirator 44 as shown in FIG. 6.

Other features shown on the drawings include small hinged door 124 at the center of a end cover 126 bolted to casing 12. An inspection opening 125 is located at the center of small door 124. Door 124 is opened for manual ignition of waste materials in primary combustion chamber 16 and for visual inspection of chamber 16.

Details of after-burner, or secondary combustion chamber, 32 are set forth in my U.S. Pat. No. 3,881,431. As shown in functional schematic FIG. 4, tangential gas jets 128 are located around the base of secondary combustion chamber 32 which supply fuel via gas line 130. Ignition for this gas is supplied by an electrical control system (not shown). Additional oxygen for combustion in secondary combustion chamber 32 is supplied through a number of tangential air jets 132 supplied by upper air ducts 40 from blower 38.

Flow of air to primary combustion chamber 16 via lower air ducts 42 and air jet outlets 100 is regulated by a photo-helix switch (not shown). The exact negative air pressure at the top of primary combustion chamber 16 is determined by the type of refuse being burned. A desirable negative air pressure is preset in a pressure regulator (not shown) in main control box 74. If the air pressure in primary chamber 16 becomes too negative for the desired combustion, the photohelix switch trips to a margal valve (not shown) to activate the automatic primary air damper (discussed previously with respect to blower 38) to open and permit a greater volume of air to move through the base area to primary combustion chamber 16.

The embodiment of the invention particulary disclosed and described herein above is presented merely as an example of the invention. Other embodiments, forms, and modifications of the invention coming within the proper scope and spirit of the appended claims will, of course, readily suggest themselves to those skilled in the art.

what is claimed is:

1. An incinerator system for combustion of waste materials comprising, in combination:

a base, an elongated casing mounted on said base forming a combustion chamber having an inner surface and having a height and an imaginary horizontal mid plane intersecting said casing at mid height, said casing forming a top outlet and a bottom outlet, a stack assembly mounted over and in operative connection with said top outlet of said combustion chamber, said casing forming a side charging entrance having a bottom side disposed no lower than said horizontal mid plane of said primary combustion chamber, side charging means being coextensive with said charging entrance for loading waste materials into said combustion chamber, wherein said side charging means includes an elongated generally horizontal hopper box forming a hopper chamber adapted to hold waste materials, and having an outlet end and an opposed end wall, said outlet end being coextensive with said charging entrance, said hopper box having a bottom area on a plane generally aligned with said bottom charging entrance, wherein said side charging means further includes an elevator platform positioned below said hopper box, an enclosed housing adapted to movably contain said elevator platform, said platform being movable in said housing between lower and upper positions, wherein in said lower position said platform is spaced below said mid plane of said combustion chamber and wherein in said upper position said platform is generally aligned with said mid plane and is aligned with said bottom area of said hopper box so as to form the lower wall of said hopper box in a plane generally aligned with said bottom side of said side charging entrance, said enclosed housing forming a charging opening adapted to pass waste materials into said platform when said platform is in said lower position, said housing having a door to said housing adapted to open and close said charging opening; and elevator power means for moving said platform between said lower and upper positions, and fan and duct means for supplying air to said combustion chamber in opposed air jets proximate said bottom outlet.

2. An incinerator system according to claim 1, further including an after-burner unit positioned over said top outlet of said combustion chamber below said stack assembly, said fan and duct means also being for supply air to said after-burner unit, further including heat recovery means positioned over said after-burner unit, said heat recovery means being for recovering heat from the hot gases from the burning waste materials and transferring said recovered heat to an outside heating unit, wherein said heat recovery means includes a main exhaust duct positioned over and downstream of said after burner unit, a by-pass duct positioned downstream of said after burner unit, said by-pass duct having an inlet and an outlet fluidly connected to said main exhaust duct, said inlet being upstream of said outlet, a suction fan positioned in said by-pass duct downstream of said by-pass control damper, and a heat exchange unit positioned in said by-pass duct downstream of said suction fan, and inlet and outlet piping connected to said heat exchanger unit and to an outside heater unit, said piping being capable of transferring heat gathered by said heat exchanger unit to said outside heater unit, said suction fan being capable of being selectively set so as to direct selected quantities of hot gas from said after-burner unit and said main exhaust duct to said heat exchanger unit.

3. The incinerator of claim 1, said casing comprising an elongated cylinder, said mid plane forming a diameter of said cylinder and said side charging entrance being disposed on one side of said cyliner.

4. An incinerator system for combustion of waste materials comprising, in combination:

a base, an elongated casing mounted on said base forming a combustion chamber having an inner surface and having a height and an imaginary horizontal mid plane intersecting said casing at mid height, said casing forming a top outlet and a bottom outlet, a stack assembly mounted over and in operative connection with said top outlet of said combustion chamber, said casing forming a side charging entrance having a bottom side disposed no lower than said horizontal mid plane of said primary combustion chamber, side charging means being coextensive with said charging entrance for loading waste materials into said combustion chamber, and fan and duct means for supplying air to said combustion chamber in opposed air jets proximate said bottom outlet, wherein said side charging means includes an elongated generally horizontal hopper box forming a hopper chamber adapted to hold waste materials, and having an outlet end and an opposed end wall, said outlet end being coextensive with said charging entrance, said hopper box having a bottom area on a plane generally aligned with said bottom charging entrance, wherein said side charging means further includes a horizontal outer ram tube and an inner ram tube concentrically mounted in and fluidly connected to said outer ram tube, said inner and outer ram tubes being connected to said end wall of said hopper box, a ram piston concentrically positioned in said inner ram tube and extending through said end wall into said hopper box, a ram blade positioned in and slidably coextensive with said hopper box and secured to said ram piston, hydraulic power means operatively connected to said inner and outer ram tubes, and hydraulic control means for activating said hydraulic power means, said ram piston being capable of moving said ram blade upon activation of said hydraulic power means between first and second positions, wherein in said first position said ram blade is positioned proximate to said outer wall of said hopper box, and in said second position said ram blade is positioned at said entrance to said first combustion chamber, said ram blade being adapted to push all the waste materials in said hopper box into said combustion chamber, wherein said side charging means further includes an elevator platform positioned below said hopper box, an enclosed housing adapted to movably contain said elevator platform, said platform being movably in said housing between lower and upper positions, wherein in said lower position said platform in spaced below said mid plane of said combustion chamber and wherein in said upper position said platform is aligned with said mid plane and is aligned with said bottom area of said hopper box so as to form the lower wall of said hopper box at a plane generally aligned with said bottom side of said side charging entrance, said enclosed housing forming a charging opening adapted to pass waste materials into said platform when said platform is in said lower position, said housing having a charging door hinged to said housing adapted to open and close said charging opening; and elevator power means for moving said platform between said lower and upper positions.

5. An incinerator system according to claim 4, wherein said side charging means further includes a vertical fire door, a vertical frame positional adjacent to said side charging entance adapted to slidingly receive said fire door, a hydraulic cylinder positioned over said vertical frame operatively connected to said fire door, and to said hydraulic power means, said fire door being movable between lower and upper positions, wherein in said lower position said fire door closes said side charging entrance of said combustion chamber and wherein in said upper position, said side charging entrance is open.

6. An incinerator system according to claim 5, further including synchronous means for deactivating said hydraulic power manes for moving said fire door to said upper position, activating said elevator power means for moving said platform from said lower position to said upper position, and activating said hydraulic power means for moving said ram piston to said side charging door after a set time delay, whereby the fire door stops its upward movement leaving the side charging door open, the elevator platform raises the waste materials into the hopper box, and the ram piston pushes the waste materials into the combustion chamber.

7. An incinerator system according to claim 6, wherein said sychronous means comprises a microswitch positioned on said vertical frame for said fire door at the top of the upper position of said fire door and electric circuitry to said elevator power means and to said hydraulic power means, said microswitch being capable of being tripped by said fire door so as to send electric signals via said electric circuits to said elevator power means and to said hydraulic power means.

8. An incinerator system according to claim 7 fan and duct means including opposed rows of fire bricks set at facing generally tangential angles on opposite side of said bottom outlet, said fire bricks forming a plurality of air channels having opposed upstream outlets and downstream inlets, said fan and duct means being for supplying air to said downstream inlets.

9. An incinerator system according to claim 8, wherein said combustion chamber has an imaginary vertical longitudinal center plane, said bottom outlet is aligned along said center plane, and said fire bricks are aligned on opposite sides of said bottom outlet and said outlets are so directed as to form jet air streams at approximately right angles to said center plane.

10. An incinerator system according to claim 9, wherein said casing is cylindrical having a longitudinal generally horizontal axis, said mid plane being aligned with said longitudinal axis, said cylindrical casing further having a vertical cross-sectional axis, said centerplane being aligned with said vertical axis.

11. An incinerator system according to claim 10, further including an after-burner unit positioned over said top oulet of said combustion chamber below said stack assembly, said fan and duct means also being for supply air to said afterburner unit.

12. An incinerator system according to claim 11, further including heat recovery means positioned over said after-burner unit, said heat recovery means being for recovering heat from the hot gases from the burning waste materials and tranferring said recovered heat to an outside heating unit.

13. An incinerator system according to claim 12, wherein said heat recovery means includes a main exhaust duct positioned over and downstream of said after burner unit, a by-pass duct positioned downstream of said after burner unit, said by-pass duct having an inlet and an outlet fluidly connected to said main exhaust duct, said inlet being upstream of said outlet, a by-pass control damper positioned in said by-pass duct immediately downstream of said inlet, a suction fan positioned in said by-pass duct downstream of said by-pass control damper, and a heat exchange unit positioned in said by-pass duct downstream of said suction fan, and inlet and outlet piping connected to said heat exchanger unit and to an outside heater unit, said piping being capable of transferring heat gathered by said heat exchanger unit to said outside heater unit, said suction fan and said control damper being capable of being selectively set so as to direct slected quantities of hot gas from said afterburner unit and said main exhaust duct to said heat exchanger unit.

* * * * *